US007970318B2

(12) United States Patent
Iwamatsu et al.

(10) Patent No.: US 7,970,318 B2
(45) Date of Patent: Jun. 28, 2011

(54) CHARGING DEVICE AND IMAGE FORMING DEVICE USING SAME

(75) Inventors: Tadashi Iwamatsu, Nara (JP); Hirofumi Kanda, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 448 days.

(21) Appl. No.: 12/085,299

(22) PCT Filed: Nov. 17, 2006

(86) PCT No.: PCT/JP2006/323004

§ 371 (c)(1),
(2), (4) Date: May 20, 2008

(87) PCT Pub. No.: WO2007/058317

PCT Pub. Date: May 24, 2007

(65) Prior Publication Data

US 2009/0041501 A1 Feb. 12, 2009

(30) Foreign Application Priority Data

Nov. 21, 2005 (JP) ..... 2005-336398
Apr. 24, 2006 (JP) ..... 2006-119836

(51) Int. Cl.
*G03G 15/02* (2006.01)

(52) U.S. Cl. ..... 399/168; 399/115

(58) Field of Classification Search ..... 399/115, 399/168

See application file for complete search history.

(56) References Cited

U.S. PATENT DOCUMENTS

| | | | | |
|---|---|---|---|---|
| 5,479,243 | A | 12/1995 | Kurokawa et al. | |
| 5,689,770 | A | 11/1997 | Kurokawa et al. | |
| 5,786,091 | A | 7/1998 | Kurokawa et al. | |
| 5,881,344 | A | 3/1999 | Kurokawa et al. | |
| 2002/0007869 | A1 * | 1/2002 | Pui et al. | 141/173 |
| 2006/0164489 | A1 * | 7/2006 | Vega et al. | 347/103 |

FOREIGN PATENT DOCUMENTS

| | | |
|---|---|---|
| JP | 05-341627 | 12/1993 |
| JP | 06-51570 | 2/1994 |
| JP | 6-83117 | 3/1994 |
| JP | 10-243995 | 9/1998 |
| JP | 2001-42598 | 2/2001 |
| JP | 2004-361453 | 12/2004 |
| JP | 2005-305972 | 11/2005 |

* cited by examiner

*Primary Examiner* — David M Gray
*Assistant Examiner* — G. M. Hyder
(74) *Attorney, Agent, or Firm* — Edwards Angell Palmer & Dodge LLP; David G. Conlin; Stephen D. LeBarron

(57) ABSTRACT

A charging device (10) includes electrospray means for inducing electrospraying through application of a voltage to an incoming liquid (11), in order to produce charged liquid droplets (13). The device (10) charges a photoreceptor drum (1) by means of the liquid droplets (13). Hence, the invention provides a charging device capable of reducing ozone production while preventing the charging device and the electrostatic latent image carrier from degrading or wearing out from friction between the device and the carrier and provides also an image forming device incorporating the charging device.

20 Claims, 16 Drawing Sheets

Cross-sectional view along axis

Cross-sectional view along circumference

Cross-sectional view along circumference

Cross-sectional view along circumference

Cross-sectional view along circumference

CHARGING DEVICE AND IMAGE FORMING DEVICE USING SAME

TECHNICAL FIELD

The present invention relates to charging devices which charge the surface of an electrostatic latent image carrier to form an electrophotographic image and also relates to image forming devices which incorporate such a charging device.

BACKGROUND ART

A corona charger has been used as a charging device for an electrostatic latent image carrier in a wide range of conventional electrophotographic image forming devices. The most common corona charger is of a scorotron type (hereinafter, "scorotron charger") which is made up of a discharge electrode, an enclosure, and a grid electrode. The grid electrode, provided behind a discharge opening of the scorotron charger, is positioned to face the electrostatic latent image carrier, but so as to make no direct mechanical contact with the carrier. Ions are discharged at the surface of the electrostatic latent image carrier through the discharge opening to charge the surface of the electrostatic latent image carrier uniformly to a predetermined positive/negative potential. The discharge electrode in the scorotron charger is a sawtooth electrode, or an array of tungsten or needle-like wires each measuring 30 to 100 μm in diameter.

Other charging devices being in practical use include those of a roller charging scheme and a brush charging scheme. A roller is positioned, in the former, closely to or in contact with the electrostatic latent image carrier to apply voltage thereto; in the latter, a brush is brought into contact with the carrier for voltage application. These charging devices advantageously allow for relatively low voltage power supply, enabling large reduction in ozone production. For example, patent document 1 discloses a double-layered charge roller made of epichlorohydrin rubber. The technology reduces ozone production and also successfully addresses a problem of non-uniform charging in the roller charging scheme.

Patent document 1: Japanese Unexamined Patent Publication No. 5-341627/1993 (Tokukaihei 5-341627; published Dec. 24, 1993)

DISCLOSURE OF INVENTION

Meanwhile, the conventional corona chargers of scorotron types (scorotron chargers) which are mentioned above are built based on the principle of corona discharge utilizing a high voltage power supply. A problem therefore arises that the scorotron chargers produce a large quantity of ozone.

Ozone is harmful to humans. Its production must be reduced to a minimum quantity possible in the image forming device. For example, the "Blue Angel Mark," an eco-friendly product identification labeling in Germany, quantitatively restricts ozone production for environmental protection purposes.

A popular solution to the ozone formation in the corona charger is to provide a filter (ozone filter) which adsorbs and decomposes the ozone to prevent it from escaping to the outside of the device. The use of the ozone filter, however, leads to other problems: the oxidizing effect of ozone adversely affects internal components, and the replacement of the ozone filter adds to running cost.

The charging device of a roller charging scheme generates corona discharge on the surface of the electrostatic latent image carrier; the surface of the electrostatic latent image carrier and the charge roller may degrade or wear out. Similar problems, the degradation and wearing of the charge brush, can occur in the charging device of a brush charging scheme. Furthermore, the electric discharge increases with the operation speed of the image forming device. That aggravates the problems and makes it more difficult to tweak the charging devices of these schemes for use in a high-speed image forming device. For these reasons, the charging devices of scorotron types are still a popular choice in high speed devices. Other approaches to reduction of ozone formation is also being sought.

A tandem full-color copying machines requires four charging devices, producing four times as much ozone as a monochromatic copying machine. As this fact demonstrates, it is especially important to solve the ozone-related problems in the color copying machine and the high-speed copying machine.

The present invention, conceived in view of the problems, has an objective of providing a charging device capable of reducing ozone production while preventing the charging device and the electrostatic latent image carrier from degrading or wearing out from friction between the device and the carrier and also of providing an image forming device incorporating the charging device.

The charging device of the present invention is, to address the problems, characterized in that the device charges a surface of an electrostatic latent image carrier to form an electrophotographic image and includes electrospray means for inducing electrospraying through application of a voltage to an incoming liquid, in order to produce charged liquid droplets, wherein the device charges the electrostatic latent image carrier by means of the liquid droplets.

The structure produces charged liquid droplets and charges an electrostatic latent image carrier by means of the liquid droplets. The structure, as evidenced here, operates based on electrospraying as the basic principles which fundamentally differs from corona discharge, the basic principles for the conventional corona charger. Therefore, unlike in the conventional corona charger, ozone hardly forms when the electrostatic latent image carrier is charged. Therefore, ozone threat to human health is unlikely.

Besides, the charging device charges the electrostatic latent image carrier by means of the liquid droplets. The charging device is thus prevented from making mechanical contact with the electrostatic latent image carrier. The charging device and the electrostatic latent image carrier are prevented from degrading or wearing out from friction between the device and the carrier.

"Charging an electrostatic latent image carrier by means of liquid droplets" refers not only to charged liquid droplets being delivered to the electrostatic latent image carrier to charge the electrostatic latent image carrier, but also to the liquid droplets, before reaching the electrostatic latent image carrier, evaporating and leaving ions behind which then reach the electrostatic latent image carrier to charge the electrostatic latent image carrier.

An image forming device of the present invention preferably includes the charging device and an electrostatic latent image carrier.

Since the image forming device includes the charging device and an electrostatic latent image carrier, the image forming device produces less ozone.

The charging device of the present invention, as described in the foregoing, includes electrospray means for inducing electrospraying through application of a voltage to an incoming liquid, in order to produce charged liquid droplets, wherein the device charges the electrostatic latent image carrier by means of the liquid droplets.

Therefore, the charging device lowers ozone formation caused by electric discharge in comparison to the conventional corona charger when the device charges the electrostatic latent image carrier. Furthermore, the charging device does not make any direct mechanical contact with the electrostatic latent image carrier; the charging device and the electrostatic latent image carrier are prevented from degrading or wearing out from friction between the device and the carrier.

The image forming device of the present invention, as described in the foregoing, includes the charging device and an electrostatic latent image carrier.

An image forming device is hence realized which is capable of reducing ozone production while preventing the charging device and the electrostatic latent image carrier from degrading or wearing out from friction between the device and the carrier.

REFERENCE NUMERALS

1 Photoreceptor Drum (Electrostatic Latent Image Carrier)
10 Charging Device
11 Liquid
13 Liquid Droplet
18 Nozzle (Electrospray Means)
20 Shutter Section (Open/close Member)
22 Grid Electrode
25 Fan (Drier)
26 Charging Device
27 Charging Device
28 Charging Device
30 Nozzle (Electrospray Means)
31 Liquid Storage Section
32 Conductor Electrode (Electrode)
34 Charging Device

BEST MODE FOR CARRYING OUT INVENTION

The following will describe an embodiment of the present invention in reference to FIGS. 1 to 19.

The present embodiment will focus on electrophotographic digital copying machines as the image forming device that is in accordance with the present invention. This is not at all meant to be limiting the scope of the invention. The image forming device in accordance with the invention is applicable also, for example, to printers and facsimile machines provided that they operate based on electrophotographic principles.

Figure 2:
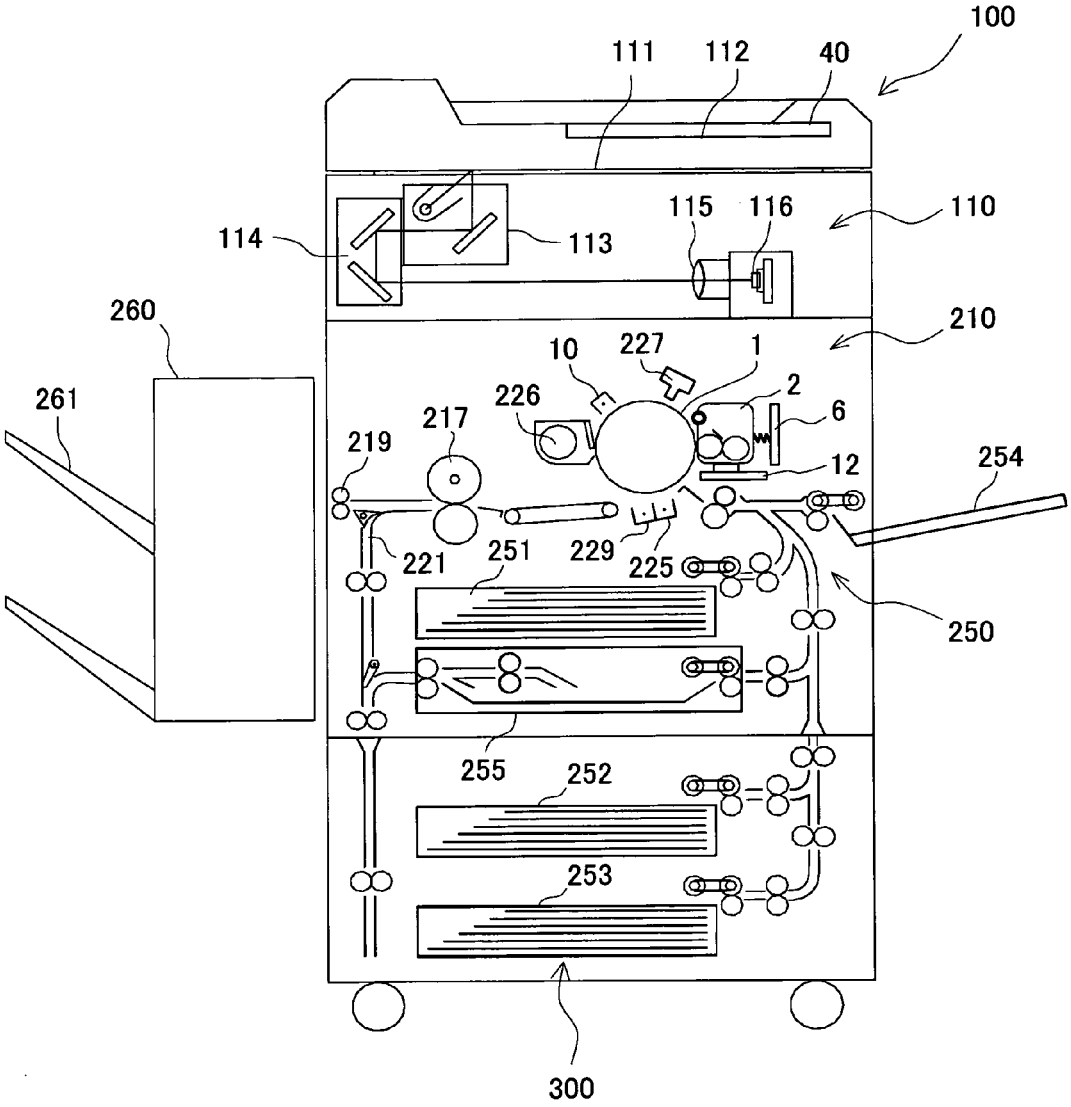
FIG. 2 is a cross-sectional view of an example of the image forming device of the present invention incorporating the charging device.

FIG. 2 is a cross-sectional view of a digital copying machine 100 incorporating a charging device 10 of the present embodiment. The digital copying machine 100 of the present embodiment, as illustrated in FIG. 2, includes an original image capture section 110, an image forming section 210, a paper feeding section 300, and a post-processing device 260.

The original image capture section 110 includes an original document platen 111 made of transparent glass, an automatic original document transport device 112 disposed in the upper part of the original image capture section 110, and an optical unit which captures an image of the original document placed on the original document platen 111.

The automatic original document transport device 112 automatically feeds the original document placed on an original document tray a sheet at a time onto the original document platen 111. The automatic original document transport device 112 serves also as a cover for the original document. The automatic original document transport device 112 is equipped with an operation panel 40 which receives job specification and other various inputs and settings associated with image formation from the user.

The optical unit is disposed below the original document platen 111 to capture an image of the original document placed on the original document platen 111 by scanning. The optical unit includes a first scan unit 113, a second scan unit 114, an optical lens 115, and a CCD line sensor (photoelectric conversion element) 116.

The first scan unit 113 includes an illumination lump unit which illuminates the face of the original document and a first mirror which reflects reflection from the original document to a predetermined direction. The second scan unit 114 includes a second and a third mirror which guide the reflection from the original document reflected by the first mirror toward the CCD line sensor 116. The optical lens 115 collects the reflection from the original document to form an image on the CCD line sensor 116. The CCD line sensor 116 performs photoelectric conversion on the reflection from the original document to generate image data which will then be output to the image forming section 210 through an image processing section (not shown).

At the bottom of the image forming section 210 is there provided a paper feeding section 300. The paper feeding section 300 includes paper cassettes 251, 252, 253, a manual feed tray 254, and a double-sided copy unit 255.

A paper transport path forms from each of the paper cassettes 251 to 253 and the manual feed tray 254 via the image forming section 210 to the post-processing device 260.

A sheet of paper fed from the paper cassettes 251 to 253, the manual feed tray 254, or the double-sided copy unit 255 goes through the transport unit 250 equipped with transport rollers and supplied to the image forming section 210.

The double-sided copy unit 255 connects to a switch back path 221 in which a sheet is turned around. The unit 255 is used to form an image on both sides of the paper. The double-sided copy unit 255 is adapted to be replaceable with an ordinary paper cassette. The double-sided copy unit 255 may be replaced with an ordinary paper cassette.

The image forming section 210 includes an image forming unit, a fusion unit 217, and sheet ejection rollers 219, to name them in the order as they appear down the paper transport path starting from the upstream end. The image forming unit includes: a photoreceptor drum (electrostatic latent image carrier) 1 as an image carrier; an optical recording device 227 as an illumination device; a charging device 10 which charges the photoreceptor drum 1 to a predetermined potential; a developer unit 2 which supplies toner to the electrostatic latent image formed on the photoreceptor drum 1 to visualize the image; a transfer device 225 of a charger scheme which transfers a toner image from the surface of the photoreceptor drum 1 to a sheet of paper; a discharger 229 which discharges the sheet so that the sheet can be readily taken off the photoreceptor drum 1; and a cleaning device 226 which collects excess toner.

Around the photoreceptor drum 1, the charging device 10, the optical recording device 227, the developer unit 2, the transfer device 225, the discharger 229, and the cleaning device 226 carry out respectively charging, illumination, development, transfer, discharging, and cleaning. During image formation, the photoreceptor drum 1 is driven to rotate at a peripheral speed of 300 mm/s.

At an image forming position located between the photoreceptor drum 1 and the transfer device 225, an image of unfused developing agent in accordance with the image data is transferred onto the surface of the sheet. The sheet is then guided down through a fusion unit 217 disposed along the paper transport path downstream to the image forming position. The fusion unit 217 heats and places pressure on the unfused developing agent on the sheet to fuse the image onto the sheet.

Moving a little down from the fusion unit 217, the paper transport path branches into two directions. One of the branches connects to the switch back path 221 in which the sheet of paper is turned around endwise to allow another image to be formed on the back of the sheet. The other branch connects to the post-processing device 260 in which the sheet now carrying an image(s) is subjected to stapling and other post-processing before being ejected onto a vertically mobile tray 261.

Next will the charging device 10 of the present embodiment be detailed in reference to figures.

The charging device 10 of the present embodiment is characterized in that the device produces positively or negatively charged fine liquid droplets to charge the electrostatic latent image carrier (photoreceptor) to a predetermined potential using the liquid droplets.

Figure 1:
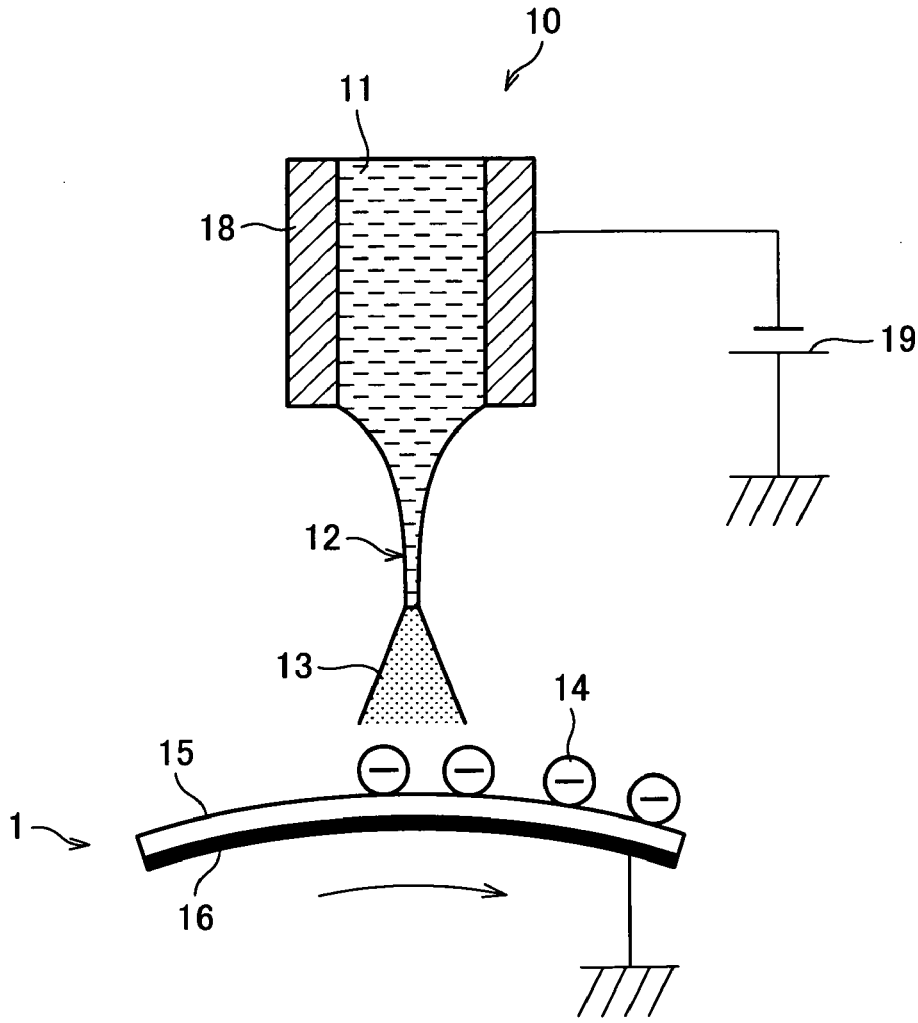
FIG. 1 is a cross-sectional view of a charging device of an embodiment of the present invention.

FIG. 1 is a cross-sectional view of a charging device of the present embodiment. The charging device 10 includes a nozzle (electrospray means) 18, a high voltage power supply 19, and a container (not shown) as illustrated in FIG. 1.

The charging device 10 is assumed to have the high voltage power supply 19 in the present embodiment. In accordance with the present invention, however, the charging device does not necessarily have a power supply. The charging device may be powered by a power supply provided outside the charging device (for example, a power supply which powers various parts of the digital copying machine 100).

The nozzle 18 is made of, for example, stainless steel or another electrically conductive material. The nozzle 18 is tapered, or becomes thinner toward the tip. In other words, the nozzle 18 is conical with its tip being chopped off. The nozzle 18 has a sharp tip. FIG. 1 is a scale-up of the tip of the nozzle 18 and shows the nozzle 18 in a cylindrical shape. In fact, the nozzle 18 is tapered as explained here.

The external diameter of the opening on the tip of the nozzle 18 is preferably 10 μm or less. This structure reduces the size of the liquid droplets ejected from the tip of the nozzle 18 to 1 μm or even smaller.

The nozzle 18 is coupled to the container (not shown) through a tube 21 (see FIG. 3; will be detailed later) so that the liquid 11 is supplied from the container to the nozzle 18. The nozzle 18 is loaded with the liquid 11 in this way.

The liquid 11 is, for example, water, an alcohol, an ether, or a mixed solution of, primarily, any of these materials. The alcohol and ether may be those available on the market. The water may be ultrapure water or tap water. The liquid 11 may or may not contain an additive(s). The additive is, for example, zinc stearate.

The nozzle 18 is electrically connected to the high voltage power supply 19 so that the high voltage power supply 19 can apply voltage to the liquid 11 via the nozzle 18. As a result, the nozzle 18 can eject fine liquid droplets 13 which are charged with the same polarity as the application voltage. The present embodiment assumes that the application voltage is negative and that the liquid droplets 13 are charged to a negative charge 14.

The photoreceptor drum 1 is disposed facing the nozzle 18 (below the nozzle 18). The photoreceptor drum 1 is constructed of a photoconductive, organic photoreceptor layer 15 and a grounded plain tube 16 which is made of aluminum. The photoreceptor drum 1 is driven to rotate as indicated by an arrow in FIG. 1.

Now, the mechanism of charging the photoreceptor drum 1 will be described.

As the nozzle 18 is loaded with the liquid 11, a substantially hemispherical meniscus of the liquid 11 forms on the tip of the nozzle 18. The meniscus forms as part of the liquid 11 bulges downward from the tip. When the high voltage power supply 19 applies negative voltage to the liquid 11 via the nozzle 18, the liquid 11 comes to carry charge of the same polarity as the application voltage. That is, the liquid 11 is charged with the same polarity as the application voltage. At a proper value of the application voltage, an electrostatic force acts on the meniscus of the liquid 11 on the tip of the nozzle 18, forming a relatively stable, conical meniscus 12 on the tip of the nozzle 18 as illustrated in FIG. 1. As the application voltage (electrostatic force) is increased in terms of its absolute value to the point that surface tension is exceeded, part of the liquid 11 separates from the extension of the tip of the conical meniscus 12, producing the fine liquid droplets 13 charged with the same polarity as the application voltage. The phenomenon is termed corn jet mode in which a uniform, stable spray state is achieved.

The liquid 11 used here preferably has a viscosity of 100 cps or lower. The relationship between the viscosity of the liquid 11 and the stability of the spray state will be described in reference to Table 1 below. In Table 1, "Optimal," "Adequate," and "Poor" indicate respectively no variations observed among liquid droplets, some variations observed among liquid droplets, and improper spraying observed. When the spray state is either Optimal or Adequate in Table 1, the spray state is regarded as being stable. When the viscosity of the liquid 11 ranges from 1 to 16 cps, the spray state is very stable. At the 100-cps viscosity, the spray state is still stable. However, as the liquid 11 has a viscosity of in excess of 100 cps, the spray state loses stability and becomes improper. This degradation is caused by resistance, produced by the liquid 11 flowing in the nozzle 18, which increases with the increasing viscosity of the liquid 11. In addition, as the viscosity of the liquid 11 increases, relatively large liquid droplets are more likely to separate from the liquid 11 without breaking apart into fine droplets, leading to an irregular spray state. As demonstrated here, the stability of the spray state changes with the viscosity of the liquid 11.

TABLE 1

| | Viscosity (cps) | | | | | |
|---|---|---|---|---|---|---|
| | 1 | 6 | 16 | 100 | 1,000 | 100,00 |
| Spray state | Optimal | Optimal | Optimal | Adequate | Poor | Poor |

The liquid droplets 13 generated by the nozzle 18 fly along the electric potential gradient between the nozzle 18 and the surface of the photoreceptor drum 1 and hit the photoreceptor drum 1, charging the photoreceptor drum 1. In other words, the photoreceptor drum 1 has electric charge 14.

If the voltage applied to the liquid 11 is increased excessively in terms of its absolute value, the spray state turns into multijet mode in which the meniscus 12 has two or more conical tips. That causes free space discharge and makes the spray state unstable, leading to non-uniform charging of the photoreceptor drum 1. If the voltage applied to the liquid 11 is further increased in terms of its absolute value, the nozzle 18 electrically discharges, possibly producing ozone.

The relationship between the value of the voltage applied to the liquid 11, electric discharge from the nozzle 18, and the type of the liquid 11 will be described in reference Table 2 which is made based on high sensitivity camera observation of the presence/absence of electric discharge from the nozzle 18 when the liquid 11 is sprayed onto the photoreceptor drum 1 in the charging device 10 shown in FIG. 1. The liquid 11 used here is water and 1:0, 1:1, 1:2, and 0:1 mixtures of hydrofluoroether and ethanol. Voltage of 1.0 kV, 2.0 kV, and 3.0 kV are applied to the liquid 11.

As shown in Table 2, when the voltage applied to the liquid 11 is 2.0 kV or less in terms of its absolute value, no electric discharge from the nozzle 18 is observed regardless of the type of the liquid 11. The table also demonstrates that the electric discharge from the nozzle 18 can be restrained not only by adjusting the value of the voltage applied to the liquid 11, but also by adjusting the mix ratio of hydrofluoroether and ethanol. As evidenced here, the electric discharge from the nozzle 18 can be restrained by adjusting the value of the voltage applied to the liquid 11 and the mix ratio of the liquid, which, in turn, enables further reduction in ozone production.

TABLE 2

| | | Mixed Solution (Hydrofluoroether:Ethanol) | | | | |
|---|---|---|---|---|---|---|
| | | 1:0 | 1:1 | 1:2 | 0:1 | Water |
| Voltage (kV) | 1.0 | No discharge | No discharge | No discharge | No discharge | No discharge |
| | 2.0 | No discharge | No discharge | No discharge | No discharge | No discharge |
| | 3.0 | No discharge | No discharge | No discharge | Discharge observed | Discharge observed |

The charging device 10 of the present embodiment is capable of controlling the spray state, as described above, by changing the electric potential of the liquid 11 on the tip of the nozzle 18 by means of the magnitude of the application voltage fed by the high voltage power supply 19.

It is known that in stable corn jet mode, the diameter of a liquid droplet is a function of the flow rate Q and the conductivity K of the liquid supplied to the nozzle and given by equation 1.

[Equation 1]

$$D_d = G(\varepsilon)(Q \cdot \tau)^{\frac{1}{3}} \qquad (1)$$
$$\tau = \frac{\varepsilon \cdot \varepsilon_0}{K}$$

where Dd is the diameter of a liquid droplet, ∈0 is the permittivity of vacuum, ∈ is the dielectric constant of the liquid, τ is the decay time constant of the electric charge, and G is a constant that is dependent on ∈.

In equation 1, once the type of the liquid is determined, τ and G are determined, and the diameter of the liquid droplet is controllable through the control of the flow rate Q.

The nozzle diameter is set up to a suitable value in the present embodiment, to control the flow rate Q of the liquid 11 by exploiting capillary phenomenon. A micro pump or similar flow rate control device may be provided to control the flow rate Q of the liquid 11 if necessary. The exploitation of capillary phenomenon eliminates the need for a flow rate control device, lowering device cost.

The charging device 10 produces the charged liquid droplets 13 and bombard the photoreceptor drum 1 with them so as to charge the photoreceptor drum 1. The photoreceptor drum 1 is charged by the electrospray mechanism explained above which fundamentally differs from the corona discharge mechanism of the conventional corona charger. The drum 1 therefore produces almost no ozone unlike the conventional corona charger. Ozone threat to human health is unlikely.

Besides, the charging device 10 does not make any direct mechanical contact with the photoreceptor drum 1. The structure prevents the charging device 10 and the photoreceptor drum 1 from degrade and wearing out from friction.

The nozzle 18 is tapered. The shape facilitates an electric field to build up at the tip. In other words, the nozzle 18 has a sharp tip; the intensity of the electric field which develops at the tip of the nozzle 18 is high even with application of low voltage. That is, the tip of the nozzle 18 is likely to generate a strong electric field even with application of low voltage. Therefore, the liquid droplets 13 can be produced with application of low voltage. The nozzle 18, even when it has an overall cylindrical shape, is capable of producing a sufficiently strong electric field if the nozzle 18 is adequately thin.

Next, the layout of the nozzle 18 in the charging device 10 will be described in reference to FIG. 3 which is a cross-sectional view of the charging device taken along the axis of the photoreceptor drum.

Figure 3:
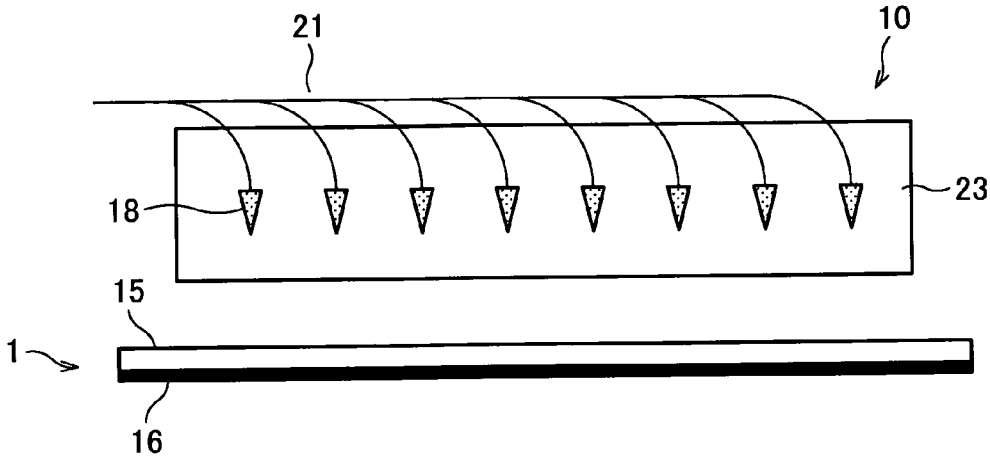
FIG. 3 is a cross-sectional view of the charging device taken along the axis of a photoreceptor drum.

The charging device 10 includes a row of multiple nozzles 18 provided therein at equal intervals along the axis of the photoreceptor drum 1 (parallel to the width of the photoreceptor drum 1) as illustrated in FIG. 3. The nozzles 18 are disposed at equal intervals to form a row at right angles to the direction in which the photoreceptor drum 1 is driven. The nozzles 18 are each connected to a container (not shown) via a different tube 21 and where necessary, housed in an enclosure 23 for protection from external shock.

More specifically, for example, a row of 30 nozzles 18 is disposed at an interval of 10 mm along axis of the photoreceptor drum 1 which has an effective length of 300 mm. The structure enables creating substantially uniform electric charge 14 along the axis of the photoreceptor drum 1. As a result, a greater area of the surface of the photoreceptor drum 1 can be charged simultaneously, which in turn enables the entire photoreceptor drum 1 to be charged substantially uniformly.

The nozzles 18 are not necessarily disposed at equal intervals in a single row. For example, the nozzles 18 may be disposed to zigzag between two or more rows. This layout permits the provision of more nozzles 18 and hence more uniform bombarding of the surface of the photoreceptor drum 1 with the liquid droplets 13 than the nozzles 18 arranged in a single row, thereby further reducing non-uniform charging of the photoreceptor drum 1.

In the description above, the liquid droplets 13 are ejected at the photoreceptor drum 1 in the same direction as gravity. However, the liquid droplets 13 may be ejected at the photoreceptor drum 1 in any direction. For example, the liquid droplets 13 may be ejected at the photoreceptor drum 1 in the opposite direction to gravity.

The latter structure is possible due to the diameters of the liquid droplets 13 discharged from the nozzles 18 which are so tiny that the droplets 13 can ignore the effect of gravity acting on them and are moved solely by the electric field between the nozzles 18 and the photoreceptor drum 1. Similar principles apply to the supplying of the liquid before spraying; the nozzles have so tiny an internal diameter near the tip that the effect of gravity is ignorable and the liquid can be supplied by capillary force. The micro pump and other flow rate control device may be used, for example, to separately control the liquid droplet diameter and when the internal diameter of the path is so large away from the nozzle tip that the liquid must be supplied against gravity.

The nozzles 18 may be replaced by needle-shaped members which would be like the nozzles 18 with the holes being plugged. When that is the case, the liquid is supplied flowing on the needle-shaped members to the tips of the members. The high voltage power supply 19 connected electrically to the needle-shaped members apply voltage to the members so that they can eject the charged liquid droplets 13 from the tips of the members. If the needle-shaped members are made of porous ceramic, the liquid can pass through the interior of the needle-shaped members and seep out from the tips of the members, enabling ejection of the charged liquid droplets 13. Therefore, substantially the same effects are achieved as with the nozzles 18 of the present embodiment.

Next will be described electrospray experiment using the charging device 10 of the present embodiment.

Figure 4:
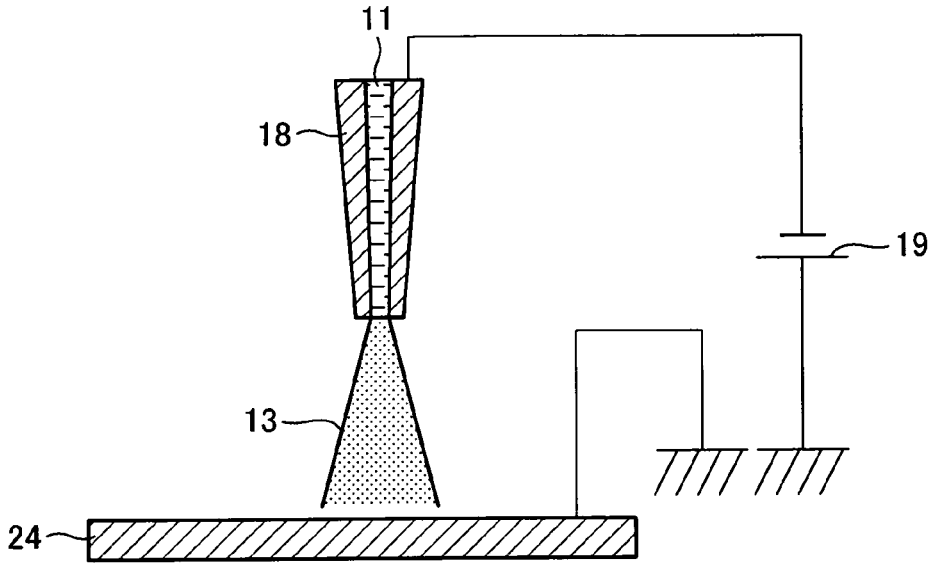
FIG. 4 is a schematic cross-sectional view of a device used in electrospray experiment.

FIG. 4 is a schematic cross-sectional view of a device used in electrospray experiment.

In this electrospray experiment, a liquid supply system (liquid container; not shown), the nozzles 18 connected electrically to the high voltage power supply 19, and a flat electrode 24 positioned to face the nozzles 18 were used. Here, each nozzle 18 had an internal diameter of 40 μm. The liquid 11 was ethanol and pure water. The flat electrode 24 was grounded for zero potential.

Under the conditions detailed above, the electric current (substrate current) which flowed from the flat electrode 24 to ground was measured with the application voltage being varied while supplying the liquid 11. It was also inspected, through observation of the shape of the meniscus on the nozzles tip by magnifying the meniscus, whether the spraying was in good electrospray state (corn jet mode), multijet mode in which the liquid breaks apart, or discharge state. Furthermore, after spraying, the surface potential of the flat electrode 24 was measured on a surface electrometer to inspect charge uniformity on the flat electrode 24.

Figure 5:
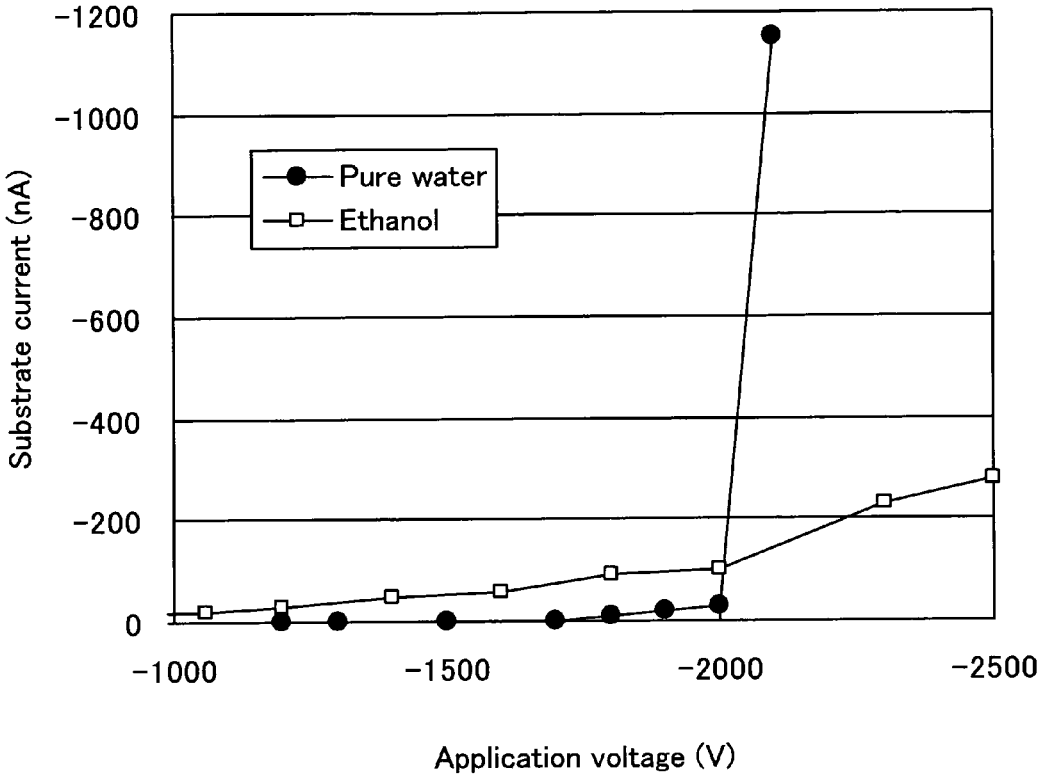
FIG. 5 is a graph representing results of the electrospray experiment.

FIG. 5 shows the application voltage and the substrate current in the electrospray experiment. The horizontal axis shows the application voltage (V), and the vertical axis shows the substrate current (nA). The substrate current (nA) plotted on the vertical axis is, as mentioned earlier, the current flowing from the flat electrode 24 to ground and is equivalent to the quantity of electric charge transferred to the flat electrode 24 per unit time by liquid droplets in electrospraying.

FIG. 5 demonstrates that when ethanol was sprayed, the substrate current (in terms of its absolute value) increased with the increasing application voltage (in terms of its absolute value). The current (in terms of its absolute value) increased rapidly starting at the application voltage of −2.0 kV due to electric discharge (discharge current flow) from the nozzles 18. For pure water spraying, the current (in terms of its absolute value) increased gradually starting at the voltage (in terms of its absolute value) of −1.8 kV and then rapidly starting at −2.0 kV.

The observation of the meniscus shape confirmed electrospraying in good corn jet mode by ethanol at the application voltage ranging from −1.2 kV to −2.0 kV. For pure water, the observation confirmed electrospraying in good corn jet mode at the application voltage ranging from −1.8 kV to −2.0 kV.

The measurement of the potential of the flat electrode 24 at its surface for various application voltages confirmed uniform charging of the electrode 24 by ethanol at the application voltage ranging from −1.2 kV to −2.0 kV. For pure water, the measurement confirmed uniform charging of the electrode 24 at the application voltage ranging from −1.8 kV to −2.0 kV.

These results confirm that electrospraying in good corn jet mode is achieved in ethanol spray at the application voltage ranging from −1.2 kV to −2.0 kV and also that in pure water spraying, electrospraying in good corn jet mode is achieved at the application voltage ranging from −1.8 kV to −2.0 kV.

Figure 6:
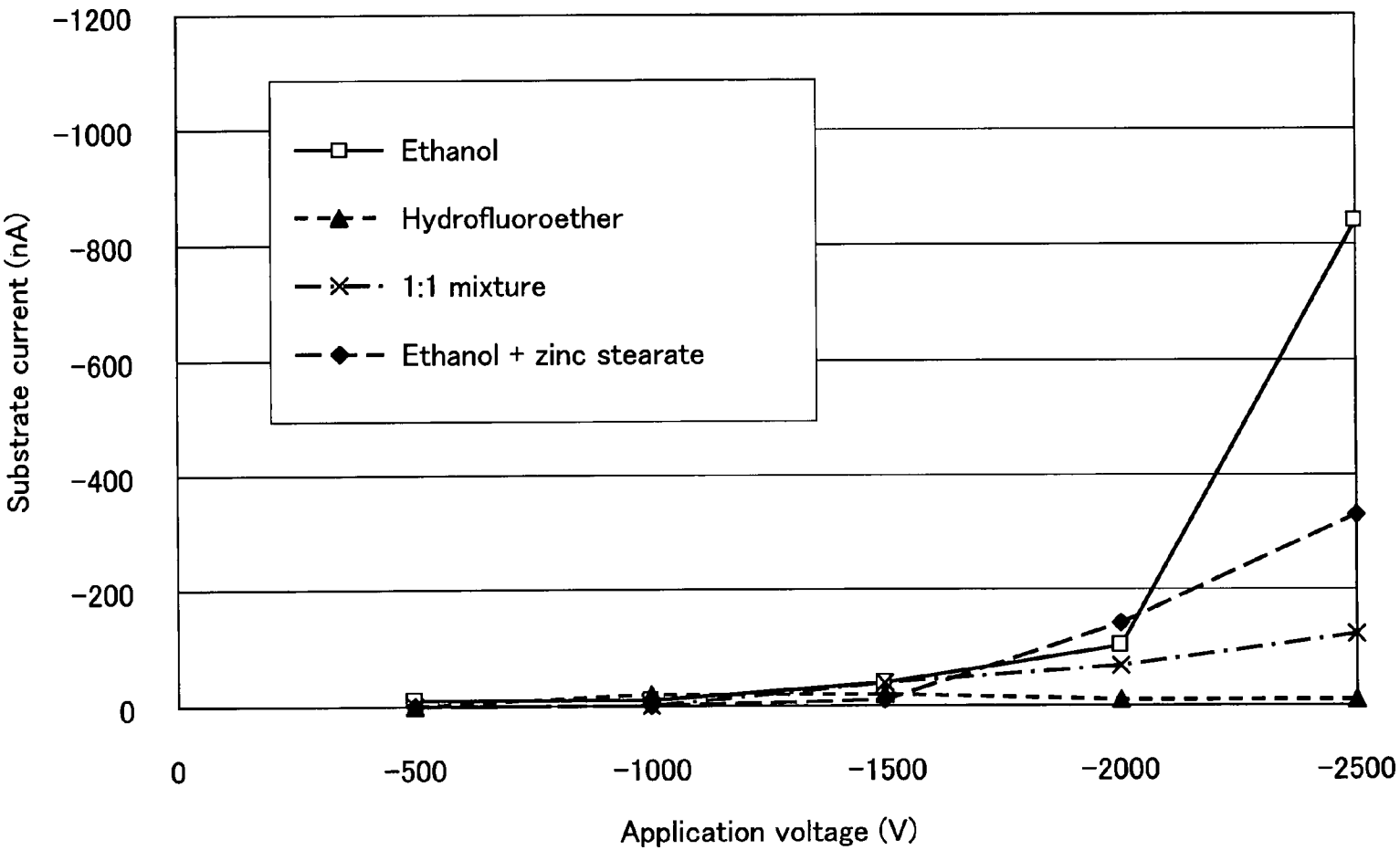
FIG. 6 is a graph representing results of the electrospray experiment.

FIG. 6 shows the application voltage and the substrate current in the same electrospray experiment. This time, however, the nozzles 18 measured 7 μm in internal diameter. The liquid 11 was ethanol, hydrofluoroether, a 1:1 liquid mixture of ethanol and hydrofluoroether, and ethanol containing 50% zinc stearate (additive) in mass. In FIG. 6, the horizontal axis shows the application voltage (V), and the vertical axis shows the substrate current (nA). The substrate current (nA) plotted on the vertical axis is, as mentioned earlier, the current flowing from the flat electrode 24 to ground and is equivalent to the quantity of electric charge transferred to the flat electrode 24 per unit time by liquid droplets in electrospraying.

As illustrated in FIG. 6, in the case of hydrofluoroether which had a low conductivity K, the spraying generated a small substrate current, whereas no discharge occurred even at −2.0 kV or a greater voltage. When the liquid mixture of ethanol and hydrofluoroether was used as the liquid 11, the substrate current is between the substrate current for pure ethanol and the substrate current for pure hydrofluoroether. Adding zinc stearate to ethanol lowered the substrate current.

As demonstrated by the experiment, the conductivity K of the liquid 11 can be changed, and hence the substrate current and discharging can be controlled, by using various liquids 11 (mixing two or more liquids, adding an additive, etc.).

Next, suitable conditions of electrospraying for the charging of the photoreceptor drum 1 will be described in more detail.

Supposing, for example, that the photoreceptor drum 1 needs to be charged to a potential of −700 V and the organic photoreceptor layer 15 is 20-μm thick and has a dielectric constant of 3, the charge density σ of the photoreceptor drum 1 at its surface is $-9.3\times10^{-4}$ C/m$^2$. Supposing a driving rate (peripheral speed) of 300 mm/s and an effective axis length of 300 mm for the photoreceptor drum 1, the electric current charging the photoreceptor drum 1 is −84 μA. Since an A4 sheet measures 210×298 mm, an electric charge of −59 μC is needed to charge the surface area of the photoreceptor drum 1 corresponding to that sheet.

In contrast, the maximum electric charge Qmax that can be held by a liquid droplet of diameter D is limited by the Rayleigh limit as in equation 2 below:

[Equation 2]

$$Q_{max}=\pi\sqrt{8\epsilon_0\gamma\cdot D^3} \quad (2)$$

Supposing a surface tension, γ, of $7.28\times10^{-2}$ N/m for a liquid, a droplet of the liquid with a diameter, ϕ, of 10 nm can hold a maximum electric charge of $7.13\times10^{-18}$ C. If liquid droplets, ϕ=10 nm, which are charged to the Rayleigh limit are generated by electrospraying and then transported to the surface of the photoreceptor drum 1 with the 100% efficiency, the quantity of the liquid needed to charge the surface area of the photoreceptor drum 1 corresponding to an A4 sheet to a predetermined potential is $4.3\times10^{-12}$ m$^3$. Similarly, for liquid droplets with a diameter of ϕ=100 nm, the quantity is $1.36\times10^{-10}$ m$^3$.

These calculations show that the photoreceptor drum 1 can be charged by a small quantity of liquid if the charged liquid droplets are formed with as small a diameter as possible. Besides, when the liquid droplets 13 have a submicron size as in the example above, only a very small quantity of liquid needs to be sprayed to obtain a needed charge. That eliminates the need for a drying step in which the surface of the photoreceptor drum 1 is dried.

In practice, it is difficult to transport the charged liquid droplets generated by the electrospraying to the photoreceptor drum with the 100% efficiency; the charged liquid droplets would be lost in electrostatic diffusion and for other various reasons.

So, the quantity of the liquid needed to charge the surface area of the photoreceptor drum 1 corresponding to an A4 sheet to a predetermined potential was measured in the electrospray experiment. The results were 100 μL at the application voltage of −1.6 kV and 83 μL at the application voltage of −2.0 kV for ethanol and 0.33 μL at the application voltage of −2.1 kV for pure water. The experiment also confirmed that for mixtures of ethanol and pure water, the conductivity K changed with the mix ratio and that this fact was exploitable in controlling the necessary quantity of liquid.

Equation 1 indicates, as mentioned above, that the diameter of the liquid droplets is controllable by controlling the flow rate Q and the conductivity K. It is hence evident that the quantity of the liquid needed to charge the surface area of the photoreceptor drum 1 corresponding to an A4 sheet is controllable.

To practically apply the charging device of the present embodiment to a electrophotographic copying machine, printer, or like image forming device, the liquid containing water, an alcohol(s), or an ether(s) needs to be made available on the market as a consumable (consumable supply). The product life (maintenance cycle) of the developing device and the electrostatic latent image carrier, measured in terms of print count, is typically 100,000 prints or more. The replacement cycle of consumables for the charging device 10 is preferably the same.

Figure 7:
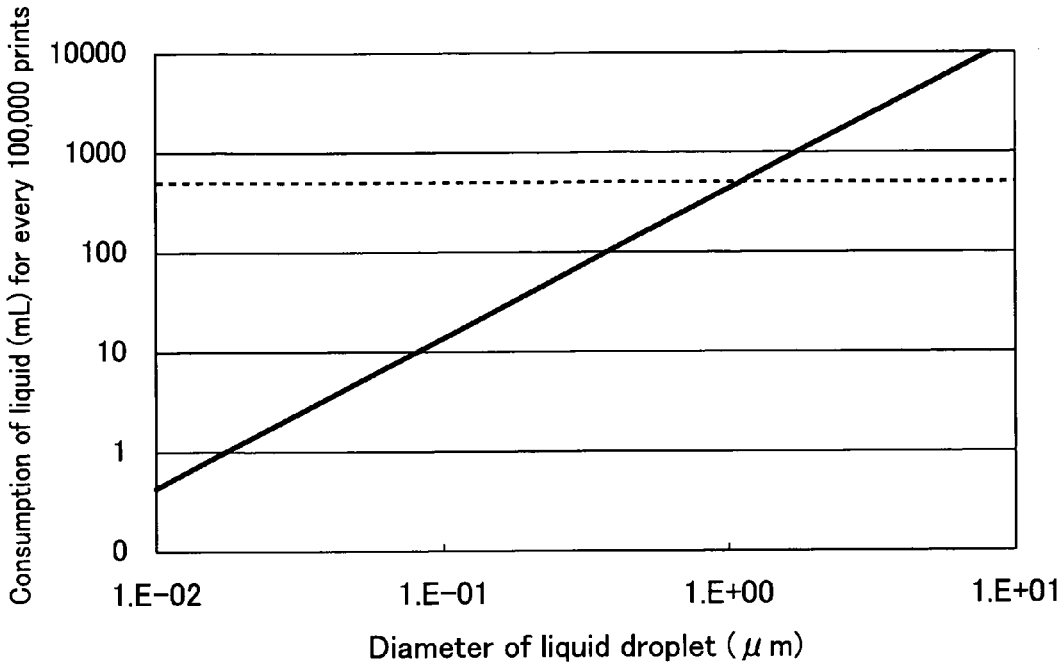
FIG. 7 is a graph representing a relationship between the diameter of droplets of spray liquid and the consumption of the liquid.

Now will be described in reference to FIG. 7 the diameter of the liquid droplets 13 which would give a 100,000-print equivalent replacement cycle for the liquid 11 supplied as a consumable. FIG. 7 is a graph representing the relationship between the diameter of the produced liquid droplets 13 and the consumption of the liquid 11 to make 100,000 prints. Supposing that the image forming device 100 can accommodate up to a 500-mL liquid container, the diameter of the liquid droplets 13 needs to be 1 μm or less in order to print 100,000 pages by using 500 ml or less of the liquid, as illustrated in FIG. 7.

The external diameter of the opening on the tip of the nozzle 18 needs to be considered to produce the liquid droplets 13 with a diameter of 1 μm or less because the liquid droplets 13 form from the meniscus the diameter of which varies depending on the external diameter of the opening on the tip of the nozzle 18. The meniscus on the tip of the nozzle 18 forms at different places depending on the affinity of the material for the tip of the nozzle 18 and the liquid droplet 13. The liquid droplet 13 however in most cases forms along the external ridge line of the nozzle 18 because the droplet 13 wets and spreads on the tip of the nozzle 18.

Figure 8:
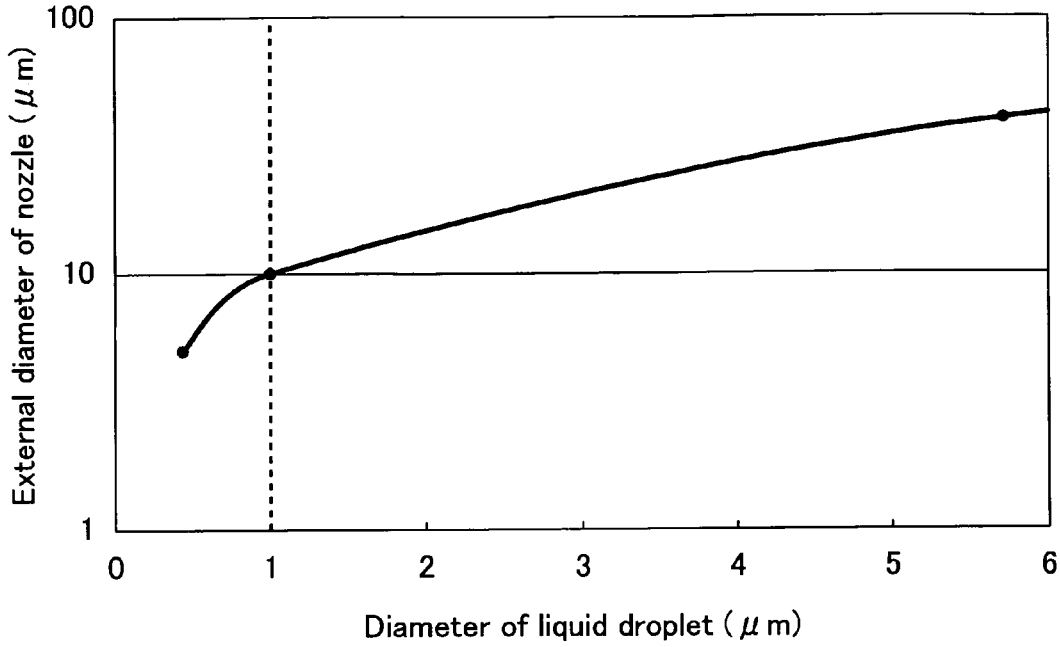
FIG. 8 is a graph representing a relationship between the diameter of droplets of spray liquid and the external diameter of the opening at the tip of a nozzle.
Figure 9:
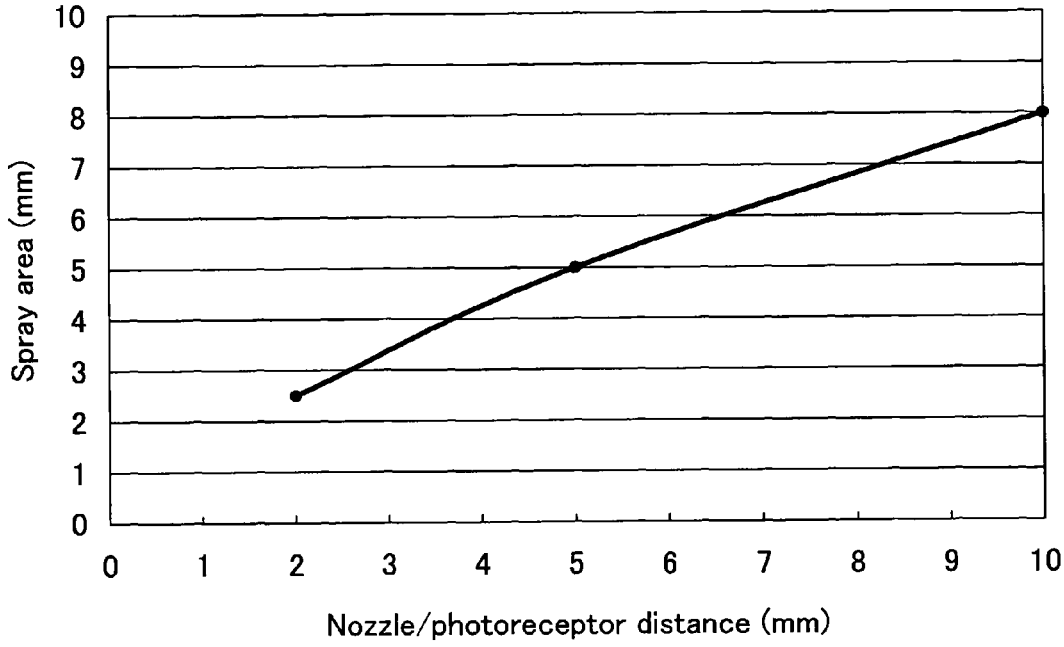
FIG. 9 is a graph representing a relationship between the nozzle-photoreceptor distance and a spray area.

Now will be described in reference to FIG. 8 the relationship between the external diameter of the opening on the tip of the nozzle 18 and the diameter of the liquid droplet 13 ejected from the opening. FIG. 8 shows that as the external diameter of the opening of the nozzle 18 grows, the diameter of the liquid droplet 13 also grows, reaching 1/7 to 1/14 times the external diameter of the opening of the nozzle 18. In FIG. 8, the diameter of the liquid droplet 13 is 1 μm when the external diameter of the opening of the nozzle 18 is 10 μm. Therefore, the external diameter of the opening of the nozzle 18 needs to be 10 μm or less in order to reduce the diameter of the liquid droplet 13 to 1 μm or less.

From these facts, the external diameter of the opening on the tip of the nozzle 18 is preferably 10 μm or less in order to reduce the capacity of the container (consumable) for spray liquid to 500 mL or less.

If the external diameter is less than or equal to 10 μm, the liquid droplet 13 is produced with a diameter of 1 μm or less and does not unnecessarily wet the surface of the photoreceptor drum 1. That eliminates the need for a drying step in which the surface of the photoreceptor drum 1 is dried. The liquid droplet 13 evaporates and escapes out of the device, if ever, only in quantity so minute that the droplet 13 can hardly do any harm to human health.

Furthermore, since the liquid 11 used is ultimately allowed to evaporate and exhaust out of the image forming device, the liquid 11 is preferably water, an alcohol(s), or an ether(s) which are harmless to humans and almost odorless. These liquids 11 hardly damage the photoreceptor drum 1 and are preferred for use in electrophotography.

The relationship between the spray area and the distance between the nozzle and the spray target was inspected using the device shown in FIG. 4 designed for electrospray experiment. The results of the experiment will be described in reference to FIG. 9, a graph representing the relationship between the spray area on the flat electrode 24 and the distance between the nozzle 18 and the flat electrode 24. The spray area increase in proportion to the distance between the nozzle 18 and the flat electrode 24. The spray area is 0.8 to 1 time the distance between the nozzle 18 and the flat electrode 24. If multiple nozzles 18 are lined up as illustrated in FIG. 3, the spray areas of individual nozzles 18 overlap by setting the interval between adjacent nozzles 18 to not greater than 0.8 times the distance between the nozzle 18 and the photoreceptor drum 1. The overlapping enables stable and uniform charging with no part of the photoreceptor drum 1 being left uncharged when viewed along the axis.

Supposing that the image forming device 100 can accommodate up to a 500-mL liquid container and taking the replacement cycle of the liquid (consumable) 11 into consideration, the quantity of the liquid 11 (liquid droplets 13) needed to charge the surface area of the photoreceptor drum 1 corresponding to an A4 sheet is preferably 5 μL or less.

If the quantity of the liquid 11 (liquid droplets 13) is in excess of 5 μL, a large container needs to be used, which adds to the size of the device. On the other hand, if a small container is used in the case above, the liquid (consumable) 11 must be replaced frequently, which adds to maintenance cost.

The results of the experiment show that, in the present embodiment, the quantity of the liquid needed for electrospraying, that is, 5 μL or less, is a value which can be achieved and controlled by controlling the flow rate Q, the conductivity K, etc. The conductivity K is adjustable, for example, by changing the ratio of ethanol, water, and hydrofluoroether and adding zinc stearate. Therefore, as mentioned earlier, the necessary quantity of the liquid is controllable according to the mix ratio of ethanol, water, and hydrofluoroether and the quantity of zinc stearate added.

The setting of the quantity of the liquid 11 (liquid droplets 13) needed to charge the surface area of the photoreceptor drum 1 corresponding to an A4 sheet to 5 μL or less prevents the surface of the photoreceptor drum 1 from getting unnecessarily wet with the liquid droplets 13 in electrospraying. That eliminates the need for a drying step in which the surface of the photoreceptor drum 1 is dried. The liquid droplets 13 evaporate and escape out of the device, if ever, only in quantity so minute that the droplets 13 can hardly do any harm to human health.

Furthermore, since the liquid used is ultimately allowed to evaporate and exhaust out of the image forming device, the liquid is preferably water or ethanol which are harmless to humans and almost odorless. These liquids hardly damage the photoreceptor drum and are suited for electrophotography.

Figure 10:
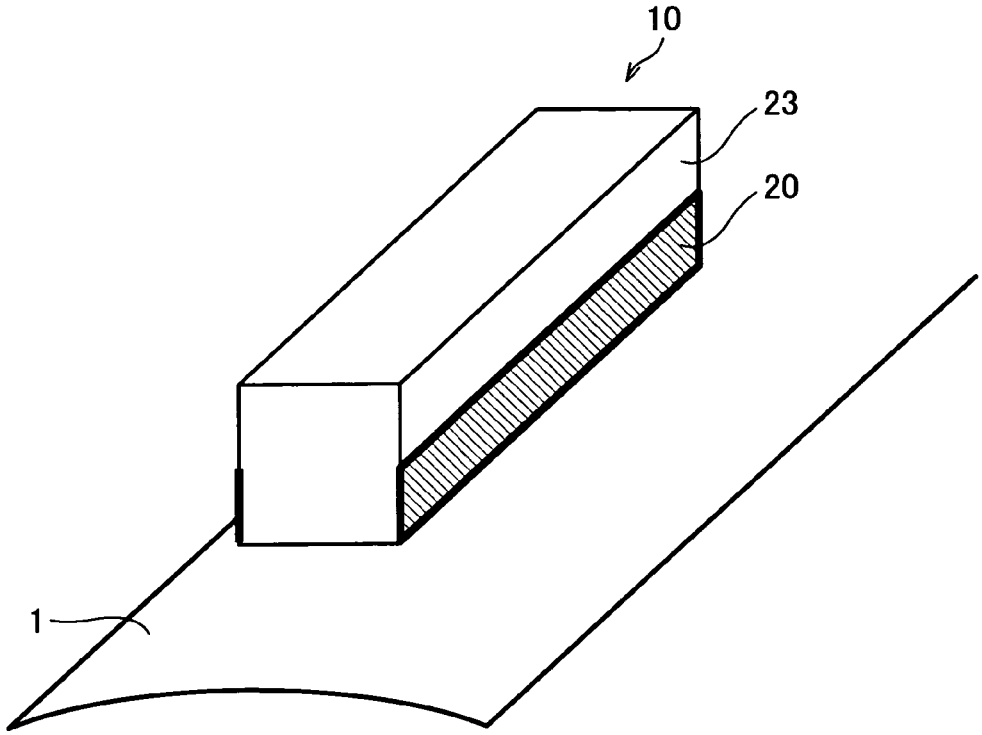
FIG. 10 is an oblique view of the charging device.
Figure 11:
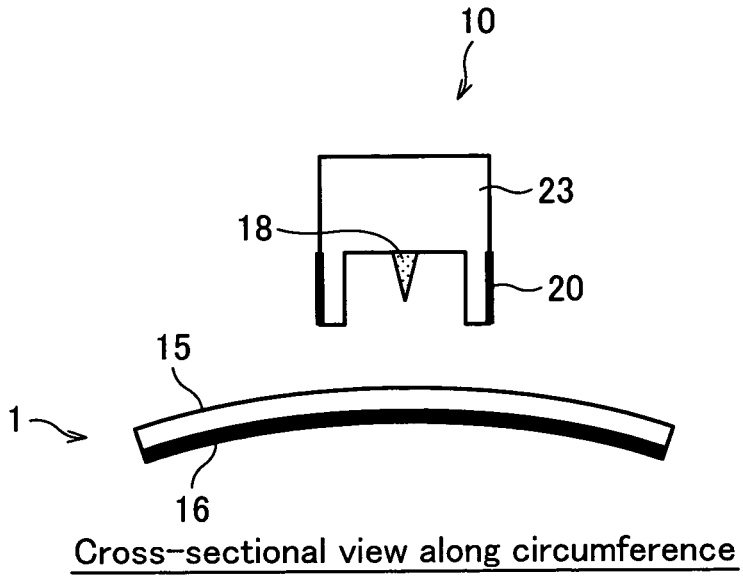
FIG. 11 is a cross-sectional view of the charging device taken along the circumference of the photoreceptor drum.
Figure 12:
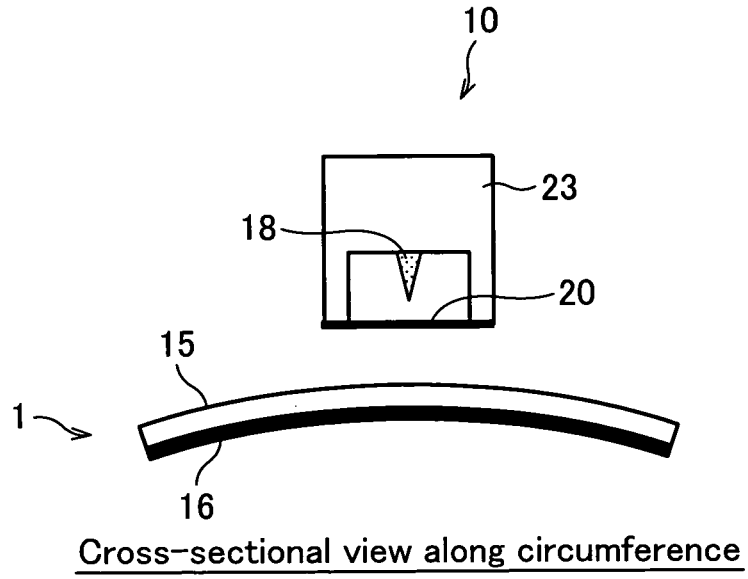
FIG. 12 is a cross-sectional view of the charging device taken along the circumference of the photoreceptor drum.

The charging device 10, constructed as in FIG. 3, may further include a shutter section (open/close member) 20 beneath the enclosure 23 in such a manner allowing the section 20 to freely open/close as illustrated in FIG. 10. FIG. 10 is an oblique view of the charging device. FIGS. 11 and 12 are cross-sectional views of the charging device taken along the circumference of the photoreceptor drum, depicting respectively the open and closed shutter section 20.

The shutter section 20 is open as illustrated in FIG. 11 while the photoreceptor drum 1 is being charged through electrospraying, allowing the charged liquid droplets 13 ejected from the nozzles 18 to reach the photoreceptor drum 1. At other times, the shutter section 20 is closed as illustrated in FIG. 12. The provision of the section 20 prevents the liquid 11 in the nozzles 18 from drying and lost during non-charging steps and also prevents the residual liquid 11 in the nozzles 18 from dropping onto the photoreceptor drum 1. The provision of the section 20 also prevents dust from entering the nozzles 18.

Figure 13:
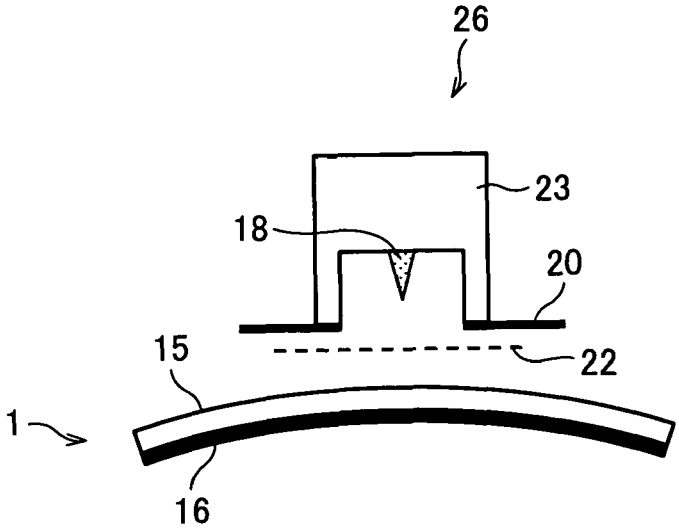
FIG. 13 is a cross-sectional view of a variation of the charging device.
Figure 14:
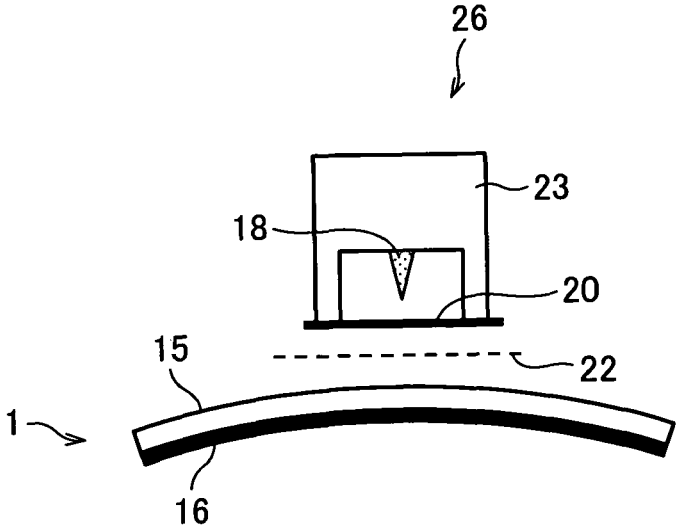
FIG. 14 is a cross-sectional view of another variation of the charging device.

FIGS. 13 and 14 show a variation example of the charging device of the present embodiment.

A charging device 26 of this variation has a grid electrode 22 between the nozzles 18 and the photoreceptor drum 1 as illustrated in FIGS. 13 and 14.

The grid electrode 22 is provided to uniformly charge the photoreceptor drum 1 and is a 0.1-mm thick, meshed electrode made of stainless steel. This grid electrode may be, for example, a grid electrode used in a conventional, scorotron-type corona charger.

Figure 15:
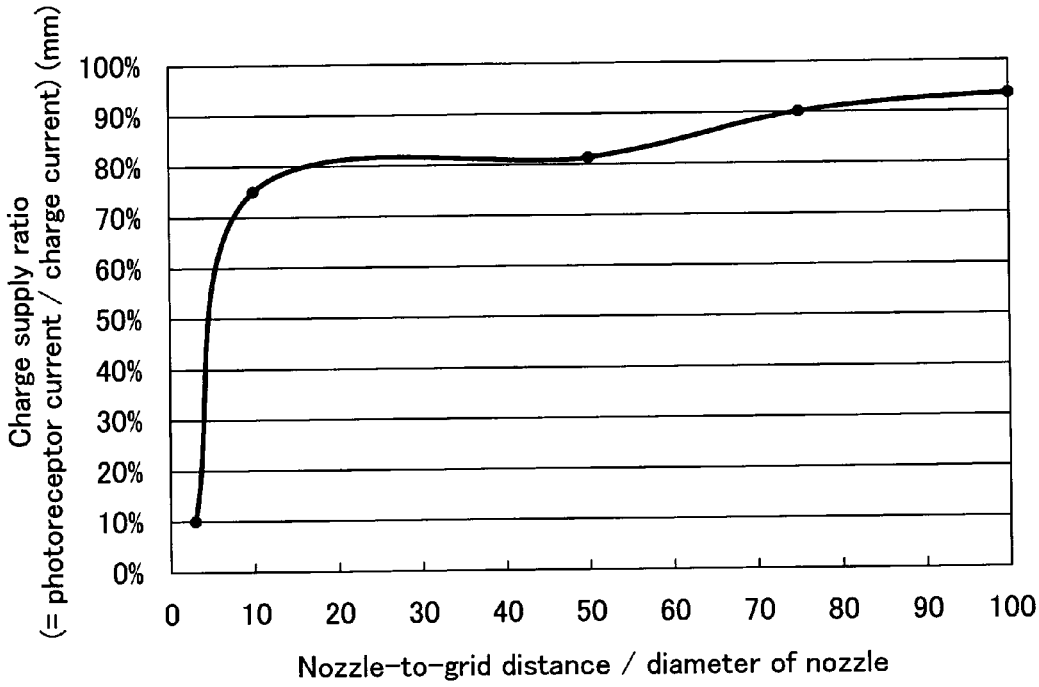
FIG. 15 is a graph representing a relationship between a gap-to-nozzle ratio and a charge supply ratio.

The relationship between the position and the charge supply ratio of the grid electrode 22 in the charging device 26 of this variation example will be described in reference to FIG. 15. Electric charges in the form of charged liquid droplets ejected from the nozzles 18 pass through the grid electrode 22 and reaches the surface of the photoreceptor drum 1. Efficiency in delivering electric charge by means of the charges in the form of charged liquid droplets ejected from the nozzles 18 varies depending on the external diameter of the openings on the tips of the nozzles 18 and the distance separating the grid electrode 22 from the nozzles 18. The charge supply ratio is defined as the ratio of the charge reaching the photoreceptor drum 1 to the charge released from the nozzles 18. The charge supply ratio varies depending on the ratio of the distance separating the grid electrode 22 from the nozzles 18 to the external diameter of the openings of the nozzles 18 ("gap-to-nozzle ratio"). As illustrated in FIG. 15, when the gap-to-nozzle ratio is 10% or less, the charge supply ratio is very low, which means that the charging efficiency for the photoreceptor drum 1 is very poor. Therefore, to achieve a high charging efficiency, the charge supply ratio is preferably increased to 70% or more by setting the gap-to-nozzle ratio to at least 10%.

If no grid electrode is provided, and the nozzles 18 are disposed at equal intervals as illustrated in FIG. 3, the quantity of droplets may increase or decrease depending on the layout of the nozzles. That leads to a non-uniform electric field developing between the nozzles 18 and the photoreceptor drum 1 and in turn to non-uniform charging of the surface of the photoreceptor drum 1.

In contrast, the charging device 26 of this variation example has the grid electrode 22 in the traveling paths of the liquid droplets. The effect of the nozzles 18 disposed at equal intervals is thus mitigated. A uniform electric field develops between the grid electrode 22 and the photoreceptor drum 1. The photoreceptor drum 1 is charged uniformly.

The shutter section 20 is open as illustrated in FIG. 10 while the photoreceptor drum 1 is being charged through electrospraying, allowing the charged liquid droplets 13 ejected from the nozzles 18 to reach the photoreceptor drum 1. The electric field between the grid electrode 22 and the photoreceptor drum 1 is uniform due to the provision of the grid electrode 22 during this charging step as mentioned earlier. In contrast, at other times, the shutter section 20 is closed as illustrated in FIG. 11. The provision of the section 20 prevents the liquid in the nozzles 18 from drying and lost.

Figure 16:
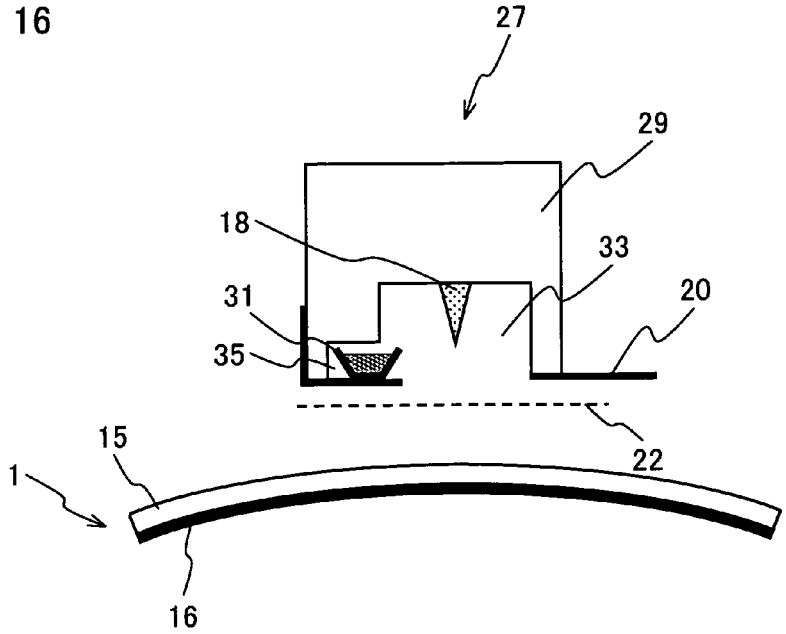
FIG. 16 is a cross-sectional view of a further variation of the charging device.
Figure 17:
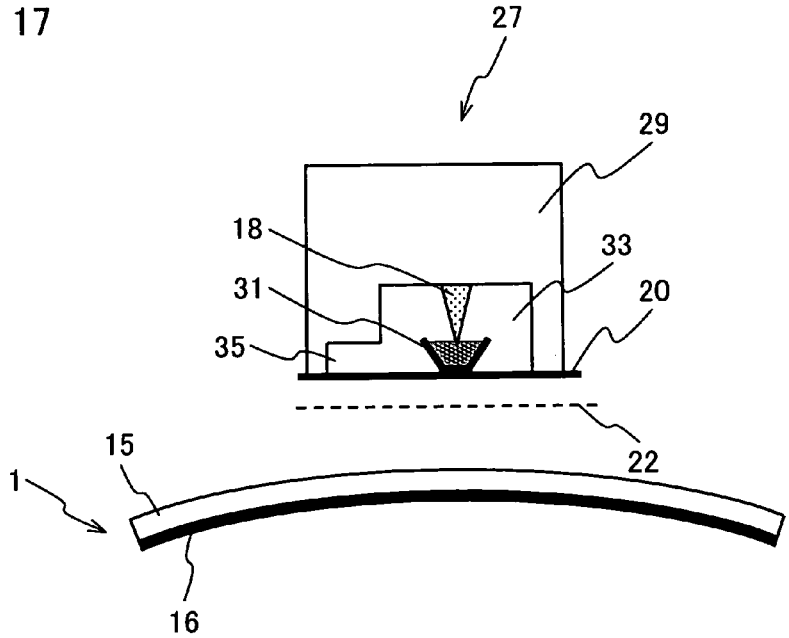
FIG. 17 is a cross-sectional view of yet another variation of the charging device.

FIGS. 16 and 17 show another variation example of the charging device of the present embodiment.

A charging device 27 of this variation has a liquid storage section 31 on a side of the shutter section 20 which faces a first concave section 33 in which the nozzles 18 of an enclosure 29 are disposed, as illustrated in FIGS. 16 and 17. The liquid storage section 31 moves sideways when the shutter section 20 opens. The liquid storage section 31 is filled with the same kind of liquid as the spray liquid 11 soaked up by an absorbing material. The absorbing material is a sponge-like liquid retaining material structured in such a manner that the nozzles 18 are not damaged. The absorbing material is provided throughout the interior of the liquid storage section 31. The enclosure 29 has inside the first concave section 33 a second concave section 35 in which the liquid storage section 31 are accommodated while the shutter section 20 is open.

While the photoreceptor drum 1 is being charged, the shutter section 20 is open, and the liquid storage section 31 on the shutter section 20 is housed in the second concave section 35 in the charging enclosure 29 as illustrated in FIG. 16. Similarly to the structure shown in FIG. 13, the charged liquid droplets 13 ejected from the nozzles 18 bombard the photoreceptor drum 1, thereby uniformly charging the photoreceptor drum 1.

At other times, as the shutter section 20 is closed as illustrated in FIG. 17, the liquid storage section 31 moves to right below the nozzles 18, and the tips of the nozzles 18 are dipped into the liquid filling the liquid storage section 31. By dipping tips of the nozzles 18 in the liquid, the foreign objects which stuck to the external walls of the openings on the tips of the nozzles 18 during the charging step are washed off. In addition, by forcefully ejecting the liquid 11 with the tips of the nozzles 18 being dipped in the liquid, the foreign objects which stuck to the interior of the nozzles are readily removed. The interior of the nozzles is thus washed. Furthermore, the interior of the nozzles can be washed by dipping the tips of the nozzles 18 once in the liquid filling the liquid storage section 31 and then lifting the tips from the liquid and forcefully ejecting the liquid 11. In other words, to wash the interior of the nozzles, there may be provided only a structure which dampens the objects sticking to the interior of the nozzles.

Figure 18:
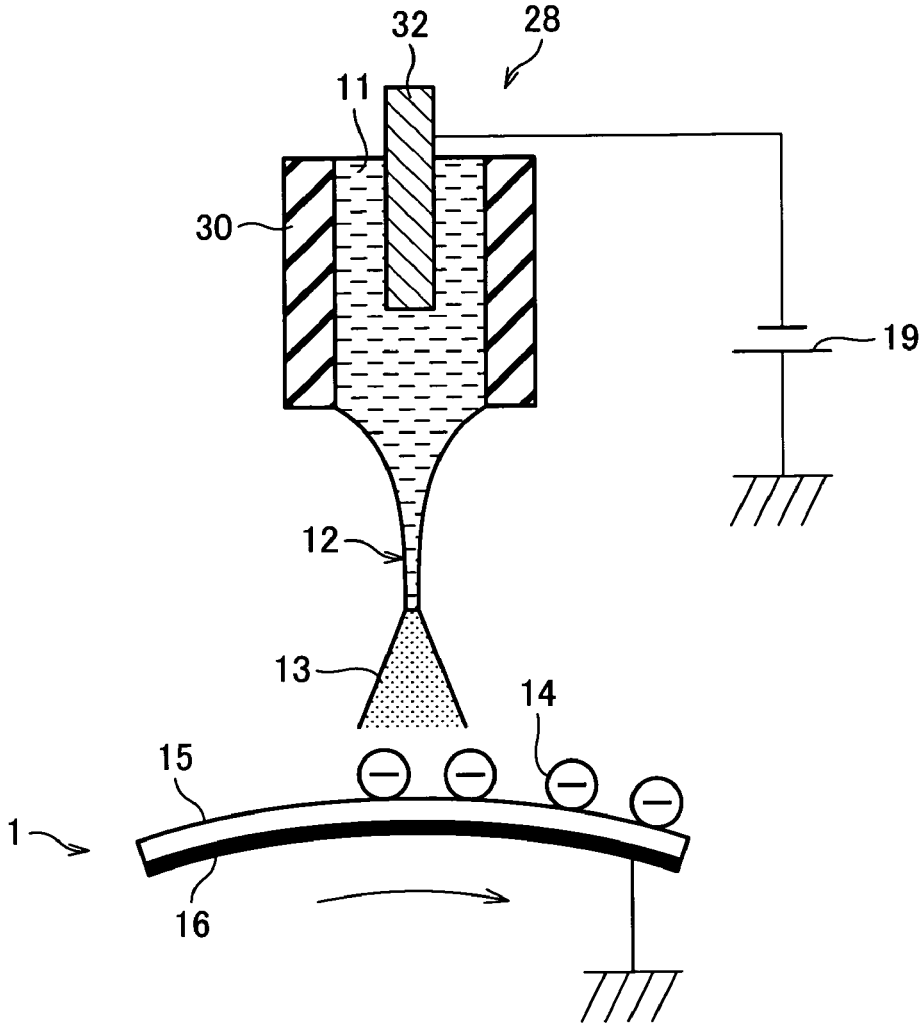
FIG. 18 is a cross-sectional view of still another variation of the charging device.

FIG. 18 is a cross-sectional view of another variation example of the charging device of the present embodiment.

A charging device 28 of this variation has nozzles 30 made of electrically non-conductive material (insulating material), in place of the nozzles 18, as illustrated in FIG. 18. A conductor electrode 32 is provided in the nozzles 30 and electrically connected to a high voltage power supply 19.

The nozzles 30 are made of glass, porous ceramic, or a like electrically non-conductive material (insulating material) and have a shape similar to that of the nozzles 18.

The conductor electrode 32 is made of stainless steel or a like electrically conductive material and has a columnar shape. The conductor electrode 32 is disposed in the tip of each nozzle 30. The electrode 32 extends along the central axis of the nozzle 30, parallel to the moving direction of the liquid 11 in the nozzle 30.

In this variation example, the high voltage power supply 19 applies a positive or negative voltage to the liquid 11 through the conductor electrode 32. The conductor electrode 32, disposed in the tip of the nozzle 30, generates an electric field concentrated in the tip of the nozzle 30. That structure enables the production of fine liquid droplets 13 charged with the same polarity as the application voltage, similarly to the charging device 10 of the present embodiment. The liquid droplets 13 are delivered to the surface of the photoreceptor drum 1, hence charging the photoreceptor drum 1.

Being made of glass or a like insulating material in this variation example, the nozzles 30 do not discharge from their tips where the electric field is most concentrated. That reduces ozone formation caused by discharging.

If the nozzle 30 is made of porous ceramic, the distribution of the electrostatic potential in the capillary of the nozzle may generate an electroosmotic flow in the nozzle. Therefore, impurities (for example, calcium and magnesium cations), if contained in the liquid, do not move toward the tip of the nozzle, but toward the conductor electrode 32. No impurities precipitate at the tip of the nozzle, much less clog the tip of the nozzle.

The conductor electrode 32 may have any shape and be arranged in any manner provided that the tip of the nozzle 30 is capable of applying voltage to the liquid 11. For example, the conductor electrode 32 may be disposed to cover the entire inner wall of the nozzle 30 near the tip so that the liquid 11 can pass through the interior of the conductor electrode 32. In that structure, the electrode 32 does not disrupt the flow of the liquid 11, more likely to produce stable liquid droplets.

Figure 19:
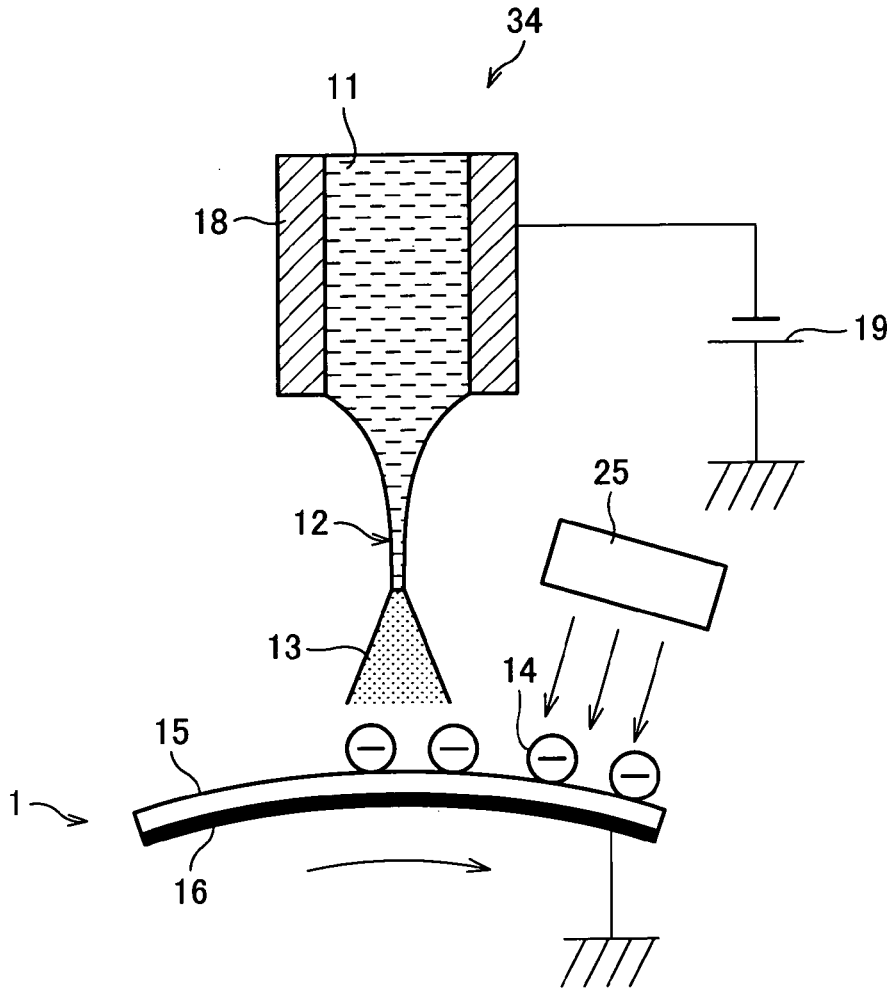
FIG. 19 is a cross-sectional view of further still another variation of the charging device.

FIG. 19 is a cross-sectional view of another variation example of the charging device of the present embodiment.

A charging device 34 in this variation has a fan 25 downstream to the drive direction in the photoreceptor drum 1 as illustrated in FIG. 19.

The fan (drier) 25 is provided to dry the liquid droplets 13 which have been delivered to the surface of the photoreceptor drum 1. The fan 25 creates an air flow to dry excess liquid droplets 13 on the surface of the photoreceptor drum 1.

The structure prevents the photoreceptor drum 1 from getting wet with the liquid droplets 13 ejected from the nozzles 18. Otherwise, the wetting could adversely affect the exposure and developing steps which will be carried out later in an electrophotographic process. Since the photoreceptor drum 1 is dried in an air flow, the photoreceptor drum 1 hardly degrades in the drying.

The liquid is preferably water, an alcohol, an ether, or a mixed solution of, primarily, any of these materials in the charging device of the present invention.

Water, alcohols, ethers, and mixed solutions of, primarily, any of these materials are hardly harmful to human health. If the liquid droplets delivered to the surface of the electrostatic latent image carrier evaporate, the droplet can hardly do any harm to human health.

The liquid preferably has a viscosity of 100 cps or lower in the charging device of the present invention.

This viscosity setting lowers the resistance acting on the liquid flowing in the nozzles, which in turn prevents improper spraying from occurring. Electric charge is delivered to the electrostatic latent image carrier by stable electrospraying. In addition, relatively large liquid droplets are less likely to separate from the liquid without breaking apart into fine droplets. The spraying becomes more uniform.

The liquid droplets by which a surface area of the electrostatic latent image carrier corresponding to an A4 sheet is charged to a predetermined potential is preferably 5 μL or less in total quantity in the charging device of the present invention.

The "predetermined potential" refers to the electric potential of the surface of the electrostatic latent image carrier needed to form an electrophotographic image.

The present invention prevents the surface of an electrostatic latent image carrier (for example, the photoreceptor drum) from getting unnecessarily wet with liquid droplets in electrospraying. That eliminates the need for a drying step in which the surface of the photoreceptor drum 1 is dried. The liquid droplets evaporate and escape out of the device, if ever, only in quantity so minute that the droplets can hardly do any harm to human health.

To practically apply the charging device of the present invention to a electrophotographic copying machine, printer, or like image forming device, the liquid needs to be made available on the market as a consumable (consumable supply). The product life (maintenance cycle) of the developing device and the electrostatic latent image carrier, measured in terms of print count, is typically 100,000 prints or more. The charging device preferably has a similar replacement cycle.

Supposing that the image forming device can accommodate up to a 500-mL liquid container, the present invention renders the liquid replacement cycle substantially equal to the maintenance cycles of the developing device and the electrostatic latent image carrier (for example, once every 100,000 prints).

The voltage applied to the liquid by the electrospray means is preferably 2.0 kV or less in the charging device of the present invention.

This setting of the liquid application voltage to 2.0 kV or less enables discharge-free spraying of the liquid onto the electrostatic latent image carrier. The spray state is stable, the electrostatic latent image carrier is uniformly charged, and ozone production is lowered.

The electrospray means in the charging device of the present invention preferably includes a tapered nozzle made of an electrically conductive material.

The structure enables the liquid to pass through the interior of the nozzle until it reaches the tip of the nozzle; the liquid is thus prevented from drying. Since the nozzle is made of electrically conductive material, voltage, if applied to the nozzle, is applied to the liquid. Furthermore, since the nozzle is tapered, a concentrated electric field is likely to develop at the tips. Therefore, the nozzle is more capable of producing liquid droplets at low application voltage than non-tapered nozzle.

The electrospray means in the charging device of the present invention preferably includes a nozzle made of an electrically non-conductive material and an electrode provided in the nozzle.

In the structure, the liquid passes through the interior of the nozzle until the liquid reaches the tip of the nozzle. The liquid is prevented from drying. If the nozzle is made of an electrically non-conductive material, discharge can occur from the tip of the nozzle where a concentrated electric field is likely to develop. The structure above, in which the nozzle is made of an electrically non-conductive material, lowers the risk of discharge. In addition, there is provided an electrode in the nozzle; voltage can be applied to the liquid through the electrode.

The nozzle in the charging device of the present invention preferably has an opening with an external diameter of 10 μm or less, the liquid droplets being produced from the opening.

The structure reduces the size of the liquid droplets produced from the opening of the nozzle to 1 μm or even smaller. That increases the electric charge delivered per unit volume of the liquid and improves efficiency in supplying electric charge.

The electrospray means in the charging device of the present invention preferably includes a plurality of those nozzles.

In the structure, the multiple nozzles produce liquid droplets. A greater surface area of the electrostatic latent image carrier can be simultaneously charged in this structure than in a structure which includes only one nozzle.

In the charging device of the present invention, preferably, $D1 \leqq 0.8 \times D2$ where D1 is an interval between the nozzles and D2 is a distance between openings of the nozzles from which the liquid droplets are produced and the surface of the electrostatic latent image carrier.

Areas sprayed by the nozzles partly overlap each other in the structure. The overlapping enables stable and uniform charging with no part of the surface of the electrostatic latent image carrier being left uncharged.

The charging device of the present invention preferably further includes an open/close member for exposing the nozzle(s) when the member is open and covering the nozzle(s) when the member is closed.

The structure prevents the liquid in the nozzle(s) from drying and prevents dust from sticking to the interior of the nozzle(s) by covering the nozzle(s) all the time except for when the charging device charges the electrostatic latent image carrier.

The charging device of the present invention preferably further includes a maintenance mechanism for dipping opening(s) of the nozzle(s) from which the liquid droplets are produced into the liquid when the charging device suspends charging.

The charging device, thus structured, is capable of removing foreign objects from the external wall(s) of the opening(s) of the nozzle(s) from which the liquid droplets are produced, by dipping the opening(s) of the nozzle(s) into the liquid. The charging device is also capable of removing foreign objects from the inner wall(s) of the opening(s) of the nozzle(s), by ejecting the liquid in the nozzle(s) with the opening(s) of the nozzle(s) being dipped to the liquid. The charging device enables washing of the opening(s) of the nozzle(s) in this manner.

The charging device of the present invention preferably further includes a grid electrode in traveling paths of the liquid droplets.

If, for example, the charging device has a plurality of nozzles disposed at equal intervals, the quantity of droplets may increase or decrease depending on the layout of the nozzles. That leads to a non-uniform electric field developing between the nozzles and the electrostatic latent image carrier and in turn to non-uniform charging of the surface of the electrostatic latent image carrier.

In the structure of the present invention, the grid electrode disposed in the traveling paths of the liquid droplets mitigates the effect of the nozzles disposed at equal intervals, enabling a uniform electric field to develop between the grid electrode and the electrostatic latent image carrier. The surface of the electrostatic latent image carrier is hence charged uniformly.

In the charging device of the present invention, preferably, $D3 \geqq 10 \times D$ where D3 is a distance between the grid electrode and openings of nozzles from which the liquid droplets are produced and D is an external diameter of the openings.

In the structure, the electric charges ejected from the nozzles by electrospraying are hardly caught by the grid electrode. 70% or more of the electric charges are delivered to the surface of the electrostatic latent image carrier. As evidenced here, the structure maintains a high charge supply ratio for the electrostatic latent image carrier.

The image forming device of the present invention preferably further includes a drier for drying the liquid droplets on the electrostatic latent image carrier.

The structure prevents excess wetting of the surface of the electrostatic latent image carrier. The exposure and developing steps which will be carried out later in an electrophotographic process are not negatively affected by excess wetting.

The drier in the image forming device of the present invention is preferably a fan.

In the structure, the surface of the electrostatic latent image carrier is dried in an air flow. The electrostatic latent image carrier therefore hardly degrades in the drying.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

A charging device in accordance with the present invention lowers the quantity of ozone produced when the device charges the electrostatic latent image carrier. The device is therefore applicable to, for example, an electrophotographic image forming device.

The invention claimed is:

1. A charging device for charging a surface of an electrostatic latent image carrier to form an electrophotographic image, said device comprising;

electrospray means for inducing electrospraying through application of a voltage to an incoming liquid, in order to produce charged liquid droplets, wherein said device charges the electrostatic latent image carrier by means of the liquid droplets.

2. The charging device of claim 1, wherein the liquid is water, an alcohol, an ether, or a mixed solution of, primarily, any of these materials.

3. The charging device of claim 1, wherein the liquid has a viscosity of 100 cps or lower.

4. The charging device of claim 1, wherein the voltage applied to the liquid by the electrospray means is 2.0 kV or less.

5. The charging device of claim 1, wherein the electrospray means includes a tapered nozzle made of an electrically conductive material.

6. The charging device of claim 1, wherein the electrospray means includes a nozzle made of an electrically non-conductive material and an electrode provided in the nozzle.

7. The charging device of either one of claim 5 or 6, wherein the electrospray means includes a plurality of the nozzle.

8. The charging device of claim 7, wherein $D1 \leqq 0.8 \times D2$ where D1 is an interval between the nozzles and D2 is a distance between openings of the nozzles from which the liquid droplets are produced and the surface of the electrostatic latent image carrier.

9. An image forming device, comprising:

a charging device of claim 1; and an electrostatic latent image carrier.

10. The image forming device of claim 9, further comprising a drier for drying the liquid droplets on the electrostatic latent image carrier.

11. The image forming device of claim 10, wherein the drier is a fan.

12. A charging device for charging a surface of an electrostatic latent image carrier to form an electrophotographic image, said device comprising:

electrospray means for inducing electrospraying through application of a voltage to an incoming liquid, in order to produce charged liquid droplets, wherein said device charges the electrostatic latent image carrier by means of the liquid droplets, and wherein the liquid droplets by which a surface area of the electrostatic latent image carrier corresponding to an A4 sheet is charged to a predetermined potential is 5 μL or less in total quantity.

13. A charging device for charging a surface of an electrostatic latent image carrier to form an electrophotographic image, said device comprising:

electrospray means for inducing electrospraying through application of a voltage to an incoming liquid, in order to produce charged liquid droplets, wherein said device charges the electrostatic latent image carrier by means of the liquid droplets, wherein the electrospray means includes a tapered nozzle made of an electrically conductive material, and wherein the nozzle has an opening with an external diameter of 10 μm or less, the liquid droplets being produced from the opening.

14. A charging device for charging a surface of an electrostatic latent image carrier to form an electrophotographic image, said device comprising:

electrospray means for inducing electrospraying through application of a voltage to an incoming liquid, in order to produce charged liquid droplets, wherein said device charges the electrostatic latent image carrier by means of the liquid droplets, and wherein the electrospray means includes a tapered nozzle made of an electrically conductive material, further comprising an open/close member for exposing the nozzle(s) when the member is open and covering the nozzle(s) when the member is closed.

15. A charging device for charging a surface of an electrostatic latent image carrier to form an electrophotographic image, said device comprising:

electrospray means for inducing electrospraying through application of a voltage to an incoming liquid, in order to produce charged liquid droplets, wherein said device charges the electrostatic latent image carrier by means of the liquid droplets, and wherein the electrospray means includes a tapered nozzle made of an electrically conductive material, further comprising a maintenance mechanism for dipping opening(s) of the nozzle(s) from which the liquid droplets are produced into the liquid when the charging device suspends charging.

16. A charging device for charging a surface of an electrostatic latent image carrier to form an electrophotographic image, said device comprising:

electrospray means for inducing electrospraying through application of a voltage to an incoming liquid, in order to produce charged liquid droplets, wherein said device charges the electrostatic latent image carrier by means of the liquid droplets, further comprising a grid electrode in traveling paths of the liquid droplets.

17. A charging device for charging a surface of an electrostatic latent image carrier to form an electrophotographic image, said device comprising:

electrospray means for inducing electrospraying through application of a voltage to an incoming liquid, in order to produce charged liquid droplets, wherein said device charges the electrostatic latent image carrier by means of the liquid droplets, further comprising a grid electrode in traveling paths of the liquid droplets, wherein $D3 \geqq 10 \times D$ where D3 is a distance between the grid electrode and openings of nozzles from which the liquid droplets are produced and D is an external diameter of the openings.

18. A charging device for charging a surface of an electrostatic latent image carrier to form an electrophotographic image, said device comprising:

electrospray means for inducing electrospraying through application of a voltage to an incoming liquid, in order to produce charged liquid droplets, wherein said device charges the electrostatic latent image carrier by means of the liquid droplets, wherein the electrospray means includes a nozzle made of an electrically non-conductive material and an electrode provided in the nozzle, and wherein the nozzle has an opening with an external diameter of 10 μm or less, the liquid droplets being produced from the opening.

19. A charging device for charging a surface of an electrostatic latent image carrier to form an electrophotographic image, said device comprising:

electrospray means for inducing electrospraying through application of a voltage to an incoming liquid, in order to produce charged liquid droplets, wherein said device charges the electrostatic latent image carrier by means of the liquid droplets, and wherein the electrospray means includes a nozzle made of an electrically non-conductive material and an electrode provided in the nozzle, further comprising an open/close member for exposing the nozzle(s) when the member is open and covering the nozzle(s) when the member is closed.

20. A charging device for charging a surface of an electrostatic latent image carrier to form an electrophotographic image, said device comprising:

electrospray means for inducing electrospraying through application of a voltage to an incoming liquid, in order to produce charged liquid droplets, wherein said device charges the electrostatic latent image carrier by means of the liquid droplets, and wherein the electrospray means includes a nozzle made of an electrically non-conductive material and an electrode provided in the nozzle, further comprising a maintenance mechanism for dipping opening(s) of the nozzle(s) from which the liquid droplets are produced into the liquid when the charging device suspends charging.

* * * * *